US009289028B1

(12) United States Patent
Anderson

(10) Patent No.: US 9,289,028 B1
(45) Date of Patent: Mar. 22, 2016

(54) MULTI-DENSITY, CUSHIONED IMPACT DISSIPATING FOOTWEAR SOLE

(76) Inventor: William T. Anderson, Lake Worth, FL (US)

( * ) Notice: Subject to any disclaimer, the term of this patent is extended or adjusted under 35 U.S.C. 154(b) by 298 days.

(21) Appl. No.: 12/965,797

(22) Filed: Dec. 10, 2010

Related U.S. Application Data

(60) Provisional application No. 61/285,967, filed on Dec. 12, 2009.

(51) Int. Cl.
*A43B 13/12* (2006.01)
*A43B 17/00* (2006.01)

(52) U.S. Cl.
CPC ..... *A43B 13/12* (2013.01); *A43B 13/125* (2013.01); *A43B 17/006* (2013.01)

(58) Field of Classification Search
CPC .... A43B 7/1405; A43B 7/1425; A43B 7/144; A43B 7/1445; A43B 7/148; A43B 13/12; A43B 13/122; A43B 13/125; A43B 13/127
USPC ..... 36/30 A, 30 R, 25 R, 28, 29, 35 R, 37
See application file for complete search history.

(56) References Cited

U.S. PATENT DOCUMENTS 4,887,367 A * 12/1989 Mackness et al. ..... 36/28
4,972,611 A * 11/1990 Swartz et al. ..... 36/28
5,542,196 A * 8/1996 Kantro ..... 36/44
6,038,790 A * 3/2000 Pyle et al. ..... 36/30 R
6,176,025 B1 * 1/2001 Patterson et al. ..... 36/28
7,392,604 B2 * 7/2008 Greene et al. ..... 36/97
2003/0150131 A1 * 8/2003 McManus et al. ..... 36/28
2004/0025375 A1 * 2/2004 Turner et al. ..... 36/29
2004/0181970 A1 * 9/2004 Covatch ..... 36/30 R
2006/0096125 A1 * 5/2006 Yen ..... 36/35 B
2008/0196272 A1 * 8/2008 Hay et al. ..... 36/88
2008/0289215 A1 * 11/2008 Park ..... 36/28
2008/0289220 A1 * 11/2008 Rivas et al. ..... 36/88

* cited by examiner

*Primary Examiner* — Khoa Huynh
*Assistant Examiner* — Megan Brandon
(74) *Attorney, Agent, or Firm* — Daniel S. Polley, P.A.

(57) ABSTRACT

A footwear sole having a variety of cushioning materials to prevent, reduce and/or eliminate foot fatigue, plantar fasciitis, and metatarsal injuries as a result of improper weight distribution to the bottom of the foot. These cushioning materials can possess differing densities and can be arranged in such a fashion so as to force the impact of the body's weight on the foot to dissipate outwards rather than straight down. The sole includes a multi-layered metatarsal design and a multi-layered heel design. When the force of the body's weight is directed downwards, it results in the wearer's heel and metatarsal absorbing the body's weight, The present invention helps to prevent or reduce this by dissipating the force outwards from the foot. An expandable ball can also be included within the heel design for further absorbing impact at heel strike.

20 Claims, 1 Drawing Sheet

12
24
16
10
First layer with poly U material 20~30 durometer
24
Second weight dissipating 20~30 durometer poly U
26
Third weight dissipating 30~40 durometer poly U
28
hole 34
22
EVA sockling 30~40 durometer
12
16
14
20
TPR Gel ball 25~35 durometer
36
18
Molded EVA with 50~58 durometer
30
Rocker Molded Rubber bottom 60~65 durometer
32

MULTI-DENSITY, CUSHIONED IMPACT DISSIPATING FOOTWEAR SOLE

This application claims priority to and the benefit of U.S. Application Ser. No. 61/285,967, filed Dec. 12, 2009, which is incorporated by reference in its entirety.

FIELD OF THE INVENTION

The present invention relates to the field of shoe design and particularly to a new multi-layered or multi-density shoe sole design that contains layers of different materials with different densities that are arranged in such a fashion so as to prevent or help to reduce injury to the user's feet.

BACKGROUND OF THE INVENTION

A well known problem associated with today's footwear is that it is not designed to adequately protect the user's feet from the natural stresses that result from walking. Improper weight distribution can cause a number of injuries to the human foot. These ailments can range from those as simple as foot fatigue to those as severe as actual metatarsal injuries. The present invention footwear sole has been designed to help overcome or at least reduce these problems.

SUMMARY OF THE INVENTION

The present invention generally provides a footwear sole having a variety of cushioning materials to prevent, reduce and/or eliminate foot fatigue, plantar fasciitis, and metatarsal injuries as a result of improper weight distribution to the bottom of the foot. These cushioning materials can possess differing densities and can be arranged in such a fashion so as to force the impact of the body's weight on the foot to dissipate outwards rather than straight down. When the force of the body's weight is directed downwards, it results in the wearer's heel and metatarsal absorbing the body's weight, The present invention helps to prevent or reduce this by dissipating the force outwards from the foot.

BRIEF DESCRIPTION OF THE DRAWINGS

For a more complete understanding of this invention, reference should now be had to the preferred embodiments illustrated in greater detail in the accompanying drawings and described below. In the drawings, which are not necessarily to scale.

DESCRIPTION OF THE PREFERRED EMBODIMENT

Figures 1, 2:
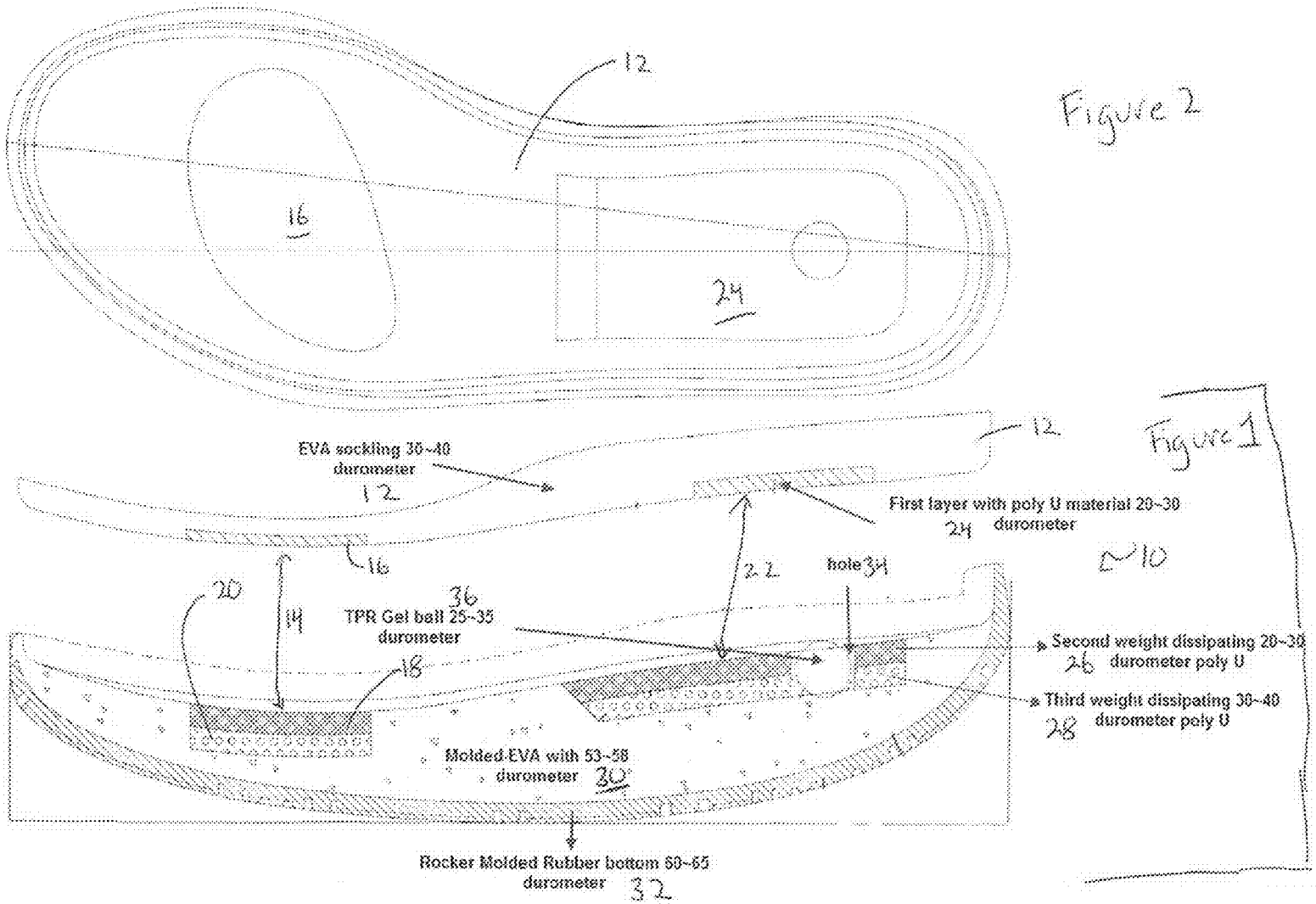
FIG. 1 depicts an exploded sectional view of the shoe sole in accordance with a preferred embodiment of the present invention.
FIG. 2 depicts a bottom view of the insole/upper sock lining and also illustrating the first weight dissipating layers of the multi-layered metatarsal design and the multi-layered heel design in accordance with a preferred embodiment of the present invention.

The present invention will now be described fully hereinafter with reference to the accompanying drawings, in which preferred embodiments of the invention are shown. This invention, however, may be embodied in different forms and should not be construed as being limited to the preferred embodiments set forth herein. Rather, these preferred embodiments are provided so that this disclosure will be thorough and complete, and will fully convey the scope of the invention to those skilled in the art. It will be understood that all alternatives, modifications, and equivalents are intended to be included within the spirit and scope of the invention.

The present invention footwear sole is shown and generally designated as sole 10. Sole 10 can comprise a variety of cushioning materials to help prevent, reduce and/or eliminate foot fatigue, plantar fasciitis, and metatarsal injuries as a result of improper weight distribution to the bottom of the foot. These cushioning materials can possess differing densities and can be arranged in such a fashion so as to force the impact of the body's weight on the foot to dissipate outwards rather than straight down. When the force of the body's weight is directed downwards, it results in the wearer's heel and metatarsal absorbing the body's weight, Footwear sole 10 helps to prevent or reduce the amount of weight absorbed by the body by dissipating the force outwards from the foot. The dissipation occurs by removing the pressure from the user's heel and metatarsal. Instead, the present invention allows the force to be gradually absorbed by the medial and lateral arch muscles of the foot. This absorption occurs during the normal walking movement, with the forward movement initiating the force transfer. The use of a forward rocking bottom, in conjunction with weight dispensing layers of different densities under the metatarsal and heel regions of the foot, as well as a firm layer under the foot's arch, permits the kinetic energy created by the forward motion to be dissipated outward from the user's foot, thereby releasing pressure on the metatarsal and heel regions of the foot and thereby reducing the chance of injury.

Therefore, force of weight dissipation can occur when pressure is first applied to the softer material in a downward motion from a softer layer to a material with a greater density on a gradual basis. This action transfers the pressure with a weight and impact reduction, which results in an off loading of the body's weight to a greater overall area of the foot. While usual custom orthotics are designed to perform the same function, they are made from a material with only one density and they also, therefore, place all of the weight on the heel and metatarsal. Thus, they do not provide the same force transference function as the present invention, and thereby fail to impart the same protection to the wearer's foot as the present invention.

Gravity and forward locomotion usually places about eighty percent of the body's weight on the heel and metatarsal. The present invention provides multiple layers of cushioning that not only dissipates the weight of the body, but also provides a gradual weight transference through this cushioning action. Thus, the process allows for a gradual dissipation of the body's weight during the forward motion of walking, which, in turn, reduces the impact of the walker's weight on the heel and metatarsal.

The present invention comprises a shoe body of ordinary construction with a specially designed multi-layered sole. The multi-layered and/or multi-density shoe sole can be incorporated into a variety of shoe types and styles and all are considered within the scope of the invention. In a preferred embodiment, the multi-layered sole comprises at least six different materials of varying densities, as measured in durometers in Scale OO. However, other number amount less and more than six, can be used, and are also considered within the scope of the invention.

As seen in FIG. 1, the materials can be arranged in the following manner. The upper sock lining 12 of shoe sole 10 is mainly comprised of a material with a durometer density falling within a range of about 30 to about 40, and preferably 35 or about 35. In another embodiment, the durometer density range can be about 5 to about 15, and preferably 10 or about 10 for the upper sock lining. While many materials may be used for this layer and all are considered within the scope of the invention, it is preferable that fabric or ethylene vinyl acetate (EVA) be used for the upper sock lining, which can also be referred to as the insole.

Underneath upper sock lining 12 can be a multi-layered metatarsal design 14 and a multi-layered heel seat design portion 22 of the multi-layered and/or multi-density sole 10. These portions can be comprised of a first weight dissipating layer 16, second weight dissipating layer 18 and third weight dissipating layer 20 for metatarsal design 14 and a first weight dissipating layer 24, second weight dissipating layer 26 and a third weight dissipating layer 28 for heel design 22.

First weight dissipating layer 16 (metatarsal) and first weight dissipating layer 24 (heel) can be mainly comprised of a polyurethane material or EVA foam (though other materials can be used are also considered within the scope of the invention) and can have a durometer density falling within a range of about 20 to about 30, and preferably 25 or about 25. In another embodiment, the durometer density range can be about 15 to about 25, and preferably 20 or about 20. As seen in FIGS. 1 and 2, layers 16 and 24 can be embedded or disposed within the bottom surface of upper sock lining, such that they flush or substantially flush with the bottom surface of upper sock lining 12.

Second weight dissipating layer 18 (metatarsal) and 26 (heel) can rest below their respective first weight dissipating layers 16 and 24 and can be mainly comprised of a polyurethane material or EVA foam (though other materials can be used and are also considered within the scope of the invention) and can have a durometer density falling within a range of about 20 to about 30 and preferably 25 or about 25. In another embodiment, the durometer density range can be about 25 to about 35 and preferably 30 or about 30.

Third weight dissipating layer 20 (metatarsal) and 28 (heel) can rest below their respective second dissipating layer 18 and 26 and can be mainly comprised of a polyurethane material or EVA foam (though other materials can be used and are also considered within the scope of the invention) and can have a durometer density falling within a range of about 30 to about 40 and preferably 35 or about 35. In another embodiment, the durometer density range can be about 35 to about 45 and preferably 40 or about 40.

Preferably surrounding the lower two layers (18 and 20) of multi-layered metatarsal design 14 and the lower two layers (26 and 28) of heel seat design 22, and preferably in direct contact with at least a portion of the sections of the upper sock lining 12 that are not in contact with multi-layered metatarsal design 14 and heel seat portion 22, can be a molded filler 30. Molded filler 30 can be mainly comprised of a EVA or Fylon foam (though other materials can be used and are also considered within the scope of the invention) and can have a durometer density falling with a range of about 53 to about 58 and preferably 55 or about 55. In another embodiment, the density durometer range can be about 45 to about 55 and preferably 50 or about 50. Lower layers 18 and 20 and 26 and 28 along with molded filler 30 can be considered the midsole portion of sole 10

Following molded filler 30 and attached to the bottom thereto can be a molded rocker bottom 32. The molded rocker bottom 32 can be mainly comprised of rubber or a thermoplastic rubber (though other materials can be used and are also considered within the scope of the invention) and can have a durometer density falling within a range of about 60 to about 65 and preferably 63 or about 63. In another embodiment, the durometer density range can be about 60 to about 70 and preferably 65 or about 65. Rocker bottom 32 can be considered the outer sole portion of sole 10.

The preceding is exemplary of the best mode for the multi-layered shoe sole. Variances in the densities and thicknesses of the layers and materials are contemplated by the invention.

Preferably located within the above-referenced layers 26 and 28 in heel design 22 of the midsole can be a hole 34, which preferably can be circular in shape though such is not considered limiting. Hole 34 can be of varying size based on the size of the shoe. A ball 36, preferably expandable, can be placed within hole 34 of varying durometer gel material based on the size of the shoe. In one embodiment ball 36 can be constructed from a thermoplastic rubber gel and can have a durometer density falling within a range of about 25 to about 35 and preferably 30 or about 30. Ball 36 can be 10% or about 10% smaller in diameter than hole 34 in which it rests (though such is not considered limiting) to allow ball 36 to expand both downward and outward thereby filling hole 34 and further absorbing impact at heel strike. Hole 34 can extend all the way through layers 26 and 28 (layer 26 having a first aperture portion of hole 34 and layer 28 being a second aperture portion of hole 34—See FIG. 1), or all the way through layer 26 and a portion of layer 28, or all the way through layer 28 and a portion of layer 26, or through a portion of layer 26 and a portion of layer 28. Additionally, hole 34 can also extend through a portion of all of first weight dissipating layer 24 as well, though such is not considered limiting. All possible combinations or configurations of a single layer or multiple layers for creating hole 34 can be used and all are considered within the scope of the invention. For clarity purposes when reading the claims, references to fourth weight dissipating layer, fifth weight dissipating layer and sixth dissipating layer in certain claims is referring to the first layer 16, second layer 18 and third layer 20 of the multi-layer metatarsal design 14 shown in FIG. 1. References to durometer density in the specification are referring to durometer density values.

It is advantageous and preferred, though not absolutely required, for the layers to be cemented, glued or otherwise permanently secured together. It is also advantageous to use a heat-activated cementing process and any commercially available EVA and rubber-compatible cement. In addition to cementing the layers of the sole together, it is also advantageous to join them together with stitching, staples, and other like means, though again not absolutely required.

LISTING OF MAIN COMPONENTS OF THE PRESENT INVENTION

10. Sole
12. Upper sock lining;
14. Multi-layered metatarsal design
16. First weight dissipating layer of metatarsal design
18. Second weight dissipating layer of metatarsal design
20. Third weight dissipating layer of metatarsal design
22. Heel seat design
24. First weight dissipating layer of heel seat design
26. Second weight dissipating layer of heel seat design
28. Third weight dissipating layer
30. Molded Filler material
32. Rocker bottom
34. Hole (preferably circular in shape though not limiting) in the heel of the midsole
36. Expandable ball Thus, generally in a preferred embodiment the present invention provides a shoe sole comprised of multiple layers of different materials with different densities arranged in such a fashion to help prevent or reduce injury to a user's foot. Each of the preferred six layers acts independently to dissipate the impact when the wearer/use steps down. Rather than one "bounce" of cushioning each layer has its own rate of absorbing the impact.

All measurements, dimensions, amounts, ranges, values, percentages, sizes, materials, locations, configurations, etc. discussed above or shown in the Figures are merely by way of example and are not considered limiting and other measurements, amounts, ranges, values, percentages, sizes, materials, locations, configurations, etc. can be chosen and used and all are considered within the scope of the invention.

While the invention has been described and disclosed in certain terms and has disclosed certain embodiments or modifications, persons skilled in the art who have acquainted themselves with the invention, will appreciate that it is not necessarily limited by such terms, nor to the specific embodiments and modification disclosed herein. Thus, a wide variety of alternatives, suggested by the teachings herein, can be practiced without departing from the spirit of the invention, and rights to such alternatives are particularly reserved and considered within the scope of the invention.

What is claimed is:

1. A multi-layered shoe sole comprising:

an upper sock lining having a first durometer density value and constructed from a single material, said upper sock lining having a first bottom cavity extending from a bottom surface of the upper sock lining to a first middle location within the upper sock lining between the bottom surface and an upper surface of the upper sock lining such that the first bottom cavity does not extend all the way through the upper sock lining, said upper sock lining having a second bottom cavity extending from a bottom surface of the upper sock lining to a second middle location within the upper sock lining between the bottom surface and the upper surface of the upper sock lining such that the second bottom cavity does not extend all the way through the upper sock lining;

a multi-layered metatarsal design, a first weight dissipating layer of cushioning material of said multi-layered metatarsal design embedded or incorporated within the first bottom cavity of said upper sock lining such that an outer surface of said first weight dissipating layer of cushioning material does not extend beyond the bottom surface of said upper sock lining, wherein in use said first weight dissipating layer of said multi-layered metatarsal design disposed above all remaining layers of said multi-layered metatarsal design while remaining unsecured to the remaining layers of said multi-layered metatarsal design;

a multi-layered heel seat design, a first weight dissipating layer of cushioning material of said multi-layered heel seat design embedded or incorporated within the second bottom cavity of said upper sock lining such that an outer surface of said first weight dissipating layer of cushioning material of said multi-layered heel seat design does not extend beyond the bottom surface of said upper sock lining, wherein in use said first weight dissipating layer of said multi-layered heel seat design disposed above all remaining layers of said multi-layered heel seat design while remaining unsecured to the remaining layers of said multi-layered heel seat design;

said outer surface of said first weight dissipating layer of cushioning material of said multi-layered metatarsal design and said outer surface of said first weight dissipating layer of cushioning material of said multi-layered heel design are substantially flush with the bottom surface of said upper sock lining to form a bottom portion for the upper sock lining;

a filler member having a second durometer density value, said filler member having a first cavity extending from a top surface of the filler member down to a first position located between the top surface of the filler member and a bottom surface of the filler member such that said multi-layered metatarsal design except for said first weight dissipating layer of said multilayered metatarsal design is disposed within said first cavity; said filler member having a second cavity extending from the top surface of the filler member down to a second position located between the top surface of the filler member and the bottom surface of the filler member such that said multi-layered heel seat design except for said first weight dissipating layer of said multilayered heel seat design is disposed within said second cavity, a portion of said filler located underneath a bottom surface of said multi-layered metatarsal design and a bottom surface of said multi-layered heel seat design; and a rocker bottom member having a third durometer density value and disposed below said filler member.

2. The multi-layered shoe sole of claim 1 wherein said first weight dissipating layer having a fourth durometer density value and in addition to said first weight dissipating layer said multi-layered metatarsal design comprising:

a second weight dissipating layer having a fifth durometer density value disposed below said first weight dissipating layer and disposed within said first cavity; and a third weight dissipating layer having a sixth durometer density value disposed below said second weight dissipating layer and disposed within said first cavity;

wherein a portion of said filler member forms a lower internal surface of the first cavity and is disposed underneath said third weight dissipating layer.

3. The multi-layered shoe sole of claim 1 wherein said first weight dissipating layer of said multi layer heel seat design having a fourth durometer density value and in addition to said first weight dissipating layer said multi-layered heel seat design comprising:

a second weight dissipating layer having a fifth durometer density value disposed below said first weight dissipating layer and disposed within said second cavity; and a third weight dissipating layer having a sixth durometer density value disposed below said second weight dissipating layer and disposed within said second cavity;

wherein a portion of said filler member forms a lower internal surface of the second cavity and is disposed underneath said third weight dissipating layer.

4. The multi-layered shoe sole of claim 3 wherein said second weight dissipating layer and said third weight dissipating layer collectively defining a hole.

5. The multi-layered shoe sole of claim 4 wherein said hole comprising a first aperture extending through said second weight dissipating layer from a top surface of said second weight dissipating layer to a bottom surface of said second weight dissipating layer and a second aperture extending through said third weight dissipating layer from a top surface of said third weight dissipating layer to a bottom surface of said third weight dissipating layer, wherein said first aperture and said second aperture are aligned with each other to form said hole.

6. The multi-layered shoe sole of claim 4 further comprising an expandable ball disposed within said hole, wherein when said expandable ball is in an expanded non-compressed position a portion of said expandable ball is located out of said hole.

7. The multi-layered shoe sole of claim 5 further comprising an expandable ball disposed within said first aperture and said second aperture, wherein when said expandable ball is in an expanded non-compressed position a portion of said expandable ball is located out of said first aperture.

8. The multi layered shoe sole of claim 1 wherein said first durometer density value is within a range of about 30 to about 40, said second durometer density value is within a range of about 53 to about 58 and said third durometer density value is within a range of about 60 to about 65.

9. The multi layered shoe sole of claim 2 wherein said fourth durometer density value is within a range of about 20 to about 30, said fifth durometer density value is within a range of about 20 to about 30 and said sixth durometer density value is within a range of about 30 to about 40.

10. The multi layered shoe sole of claim 3 wherein said fourth density durometer is within a range of about 20 to about 30, said fifth durometer density value is within a range of about 20 to about 30 and said sixth durometer density value is within a range of about 30 to about 40.

11. A multi-layered shoe sole comprising:

an upper sock lining constructed from a same material throughout and having a first durometer density value, said upper sock lining having a first bottom cavity extending from a bottom surface of the upper sock lining to a first middle location within the upper sock lining between the bottom surface and an upper surface of the upper sock lining such that the first bottom cavity does not extend all the way through the upper sock lining, said upper sock lining having a second bottom cavity extending from a bottom surface of the upper sock lining to a second middle location within the upper sock lining between the bottom surface and the upper surface of the upper sock lining such that the second bottom cavity does not extend all the way through the upper sock lining;

a multi-layered heel seat design having a first weight dissipating layer of cushioning material having a second durometer density value, a second weight dissipating layer of cushioning material having a third durometer density value and disposed below said first weight dissipating layer, and a third weight dissipating layer of cushioning material having a fourth durometer density value and disposed below said second weight dissipating layer, said first weight dissipating layer embedded or incorporated within the second bottom cavity of said upper sock lining such that an outer surface of said first weight dissipating layer of cushioning material does not extend beyond the bottom surface of said upper sock lining, wherein in use said first weight dissipating layer of said multi-layered heel seat design disposed above the second and third weight dissipating layers of said multi-layered heel seat design while remaining unsecured to the second and third weight dissipating layers of said multi-layered heel seat design;

a multi-layered metatarsal design having a fourth weight dissipating layer of cushioning material having a fifth durometer density value, a fifth weight dissipating layer of cushioning material having a sixth durometer density value and disposed below said fourth weight dissipating layer, and a sixth weight dissipating layer of cushioning material having a seventh durometer density value and disposed below said fifth weight dissipating layer, said fourth weight dissipating layer embedded or incorporated within the first bottom cavity of said upper sock lining such that an outer surface of said fourth weight dissipating layer of cushioning material does not extend beyond the bottom surface of said upper sock lining, the outer surface of said fourth weight dissipating layer of cushioning material in contact with a top surface of said fifth weight dissipating layer of cushioning material and a bottom surface of said fifth weight dissipating layer of cushioning material in contact with a top surface of said sixth weight dissipating layer of cushioning material, when in use said fourth weight dissipating layer of said multi-layered metatarsal design disposed above the fifth and sixth weight dissipating layers of said multi-layered metatarsal design while remaining unsecured to the fifth and sixth weight dissipating layers of said multi-layered metatarsal design;

said outer surface of said first weight dissipating layer of cushioning material and said outer surface of said fourth weight dissipating layer of cushioning material are substantially flush with the bottom surface of said upper sock lining to form a substantially smooth bottom portion for the upper sock lining;

a filler member having an eighth durometer density value and having a first cavity extending from a top surface of the filler member down to a first position located between the top surface of the filler member and a bottom surface of the filler member such that said multi-layered heel seat design except for said first weight dissipating layer is disposed within said first cavity; said filler member having a second cavity extending from the top surface of the filler member down to a second position located between the top surface of the filler member and the bottom surface of the filler member such that said multi-layered metatarsal design except for said fourth weight dissipating layer is disposed within said second cavity, said upper sock lining disposed over at least a portion of said filler member;

wherein a first portion of said filler member forms a lower internal surface of said first cavity and is disposed underneath said third weight dissipating layers of said multi-layered metatarsal design and a second portion of said filler member forms a lower internal surface of said second cavity and is disposed underneath said third weight dissipating layer of said multi-layered heel seat design; and a rocker bottom member having a ninth durometer density value and disposed below said filler member.

12. The multi-layered shoe sole of claim 11 wherein said second weight dissipating layer defining a first aperture extending therethrough from a top surface of said second weight dissipating layer to a bottom surface of said second weight dissipating layer and said third weight dissipating layer defining a second aperture extending therethrough from a top surface of said third weight dissipating layer to a bottom surface of said third weight dissipating layer, wherein said first aperture and said second aperture are aligned with each other to form a hole.

13. The multi-layered shoe sole of claim 12 further comprising an expandable ball disposed within said hole, wherein when said expandable ball is in an expanded non-compressed position a portion of said expandable ball is located out of said hole.

14. The multi-layered shoe sole of claim 11 wherein said first durometer density value is between about 30 to about 40, said second durometer density value is between about 20 to about 30, said third durometer density value is between about 20 to about 30, said fourth durometer density value is between about 30 to about 40, said fifth durometer density value is between about 20 to about 30, said sixth durometer density value is between about 20 to about 30, said seventh durometer density value is between about 30 to about 40, said eighth durometer density value is between about 53 to about 58 and said ninth durometer density value is between about 60 to about 65.

15. The multi-layered shoe sole of claim 11 wherein said second durometer density value is the same as said fifth durometer density value, said third durometer density value is the same as said sixth durometer density value and said fourth durometer density value is the same as said seventh durometer density value.

16. The multi-layered shoe sole of claim 11 wherein said first durometer density value is 10 or about 10, said second durometer density value and said fifth durometer density value are both 20 or about 20, said third durometer density value and said sixth durometer density value are both 30 or about 30, said fourth durometer density value and said seventh durometer density value are both 40 or about 40, said eighth durometer density value is 50 or about 50 and said ninth durometer density value is 65 or about 65.

17. A multi-layered shoe sole comprising:

an upper sock lining constructed from a same EVA material throughout and having a first durometer density value between about 30 to about 40, said upper sock lining having a first bottom cavity extending from a bottom surface of the upper sock lining to a first middle location within the upper sock lining between the bottom surface and an upper surface of the upper sock lining such that the first bottom cavity does not extend all the way through the upper sock lining, said upper sock lining having a second bottom cavity extending from a bottom surface of the upper sock lining to a second middle location within the upper sock lining between the bottom surface and the upper surface of the upper sock lining such that the second bottom cavity does not extend all the way through the upper sock lining;

a multi-layered heel seat design having a first weight dissipating layer of cushioning material having a second durometer density value between about 20 to about 30, a second weight dissipating layer of cushioning material having a third durometer density value between about 20 to about 30 and disposed below said first weight dissipating layer, and a third weight dissipating layer of cushioning material having a fourth durometer density value between about 30 to about 40 and disposed below said second weight dissipating layer, said first weight dissipating layer embedded or incorporated within the second bottom cavity of said upper sock lining such that an outer surface of said first weight dissipating layer of cushioning material does not extend beyond the bottom surface of said upper sock lining, wherein in use said first weight dissipating layer of said multi-layered heel seat design disposed above the second and third weight dissipating layers of said multi-layered heel seat design while remaining unsecured to the second and third weight dissipating layers of said multi-layered heel seat design;

a multi-layered metatarsal design having a fourth weight dissipating layer of cushioning material having a fifth durometer density value between about 20 to about 30, a fifth weight dissipating layer of cushioning material having a sixth durometer density value between about 20 to about 30 and disposed below said fourth weight dissipating layer, and a sixth weight dissipating layer of cushioning material having a seventh durometer density value between about 30 to about 40 and disposed below said fifth weight dissipating layer, said fourth weight dissipating layer embedded or incorporated within the first bottom cavity of said upper sock lining such that an outer surface of said fourth weight dissipating layer of cushioning material does not extend beyond the bottom surface of said upper sock lining, the outer surface of said fourth weight dissipating layer of cushioning material in contact with a top surface of said fifth weight dissipating layer of cushioning material and a bottom surface of said fifth weight dissipating layer of cushioning material in contact with a top surface of said sixth weight dissipating layer of cushioning material such that the fifth dissipating layer is fully above the sixth dissipating layer, when in use said fourth weight dissipating layer of said multi-layered metatarsal design disposed above the fifth and sixth weight dissipating layers of said multi-layered metatarsal design while remaining unsecured to the fifth and sixth weight dissipating layers of said multi-layered metatarsal design;

said outer surface of said first weight dissipating layer of cushioning material and said outer surface of said fourth weight dissipating layer of cushioning material are substantially flush with the bottom surface of said upper sock lining to form a substantially smooth bottom portion for the upper sock lining;

a molded filler member having an eighth durometer density value between about 53 to about 58, said filler member defining a first cavity extending from a top surface of the filler member down to a first position located between the top surface of the filler member and a bottom surface of the filler member such that said multi-layered heel seat design except for said first weight dissipating layer is disposed within said first cavity, said filler member defining a second cavity extending from a top surface of the filler member down to a second position located between the top surface of the filler member and the bottom surface of the filler member such that said multi-layered metatarsal design except for said fourth weight dissipating layer is disposed within said second cavity, said upper sock lining disposed over at least a portion of said filler member, said molded filler member disposed underneath said third weight dissipating layer and said sixth weight dissipating layer;

a molded rocker bottom member having a ninth durometer density value between about 60 to about 65 and disposed below said filler member;

wherein a first portion of said filler member forms a lower internal surface of said first cavity and is disposed underneath said third weight dissipating layers of said multi-layered metatarsal design and a second portion of said filler member forms a lower internal surface of said second cavity and is disposed underneath said third weight dissipating layer of said multi-layered heel seat design;

wherein said second weight dissipating layer defining a first aperture extending therethrough from a top surface of said second weight dissipating layer to a bottom surface of said second weight dissipating layer and said third weight dissipating layer defining a second aperture extending therethrough from a top surface of said third weight dissipating layer to a bottom surface of said third weight dissipating layer, wherein said first aperture and said second aperture are aligned with each other to form a hole; and an expandable ball disposed within said hole, wherein when said expandable ball is in an expanded non-compressed position a portion of said expandable ball is located out of said hole.

18. The multi-layered shoe sole of claim 17 wherein said second durometer density value is the same as said fifth durometer density value, said third durometer density value is the same as said sixth density durometer value and said fourth durometer density value is the same as said seventh durometer density value.

19. The multi-layered shoe sole of claim 17 wherein said expandable ball having tenth durometer density value falling within a range of about 25 to about 35.

20. The multi-layered shoe sole of claim 17 wherein said upper sock lining is at least primarily constructed from fabric or ethylene vinyl acetate, said first weight dissipating layer, said second weight dissipating layer, said third weight dissipating layer, said fourth weight dissipating layer, said fifth weight dissipating layer and said sixth weight dissipating layer are all at least primarily constructed from ethylene vinyl acetate or polyurethane, said filler member is at least primarily constructed from ethylene vinyl acetate or a foam, said rocker bottom is at least primarily constructed from thermoplastic rubber or rubber and said expandable ball is at least primarily constructed from a thermoplastic rubber gel.

* * * * *